US009318823B2

(12) United States Patent
Lee et al.

(10) Patent No.: US 9,318,823 B2
(45) Date of Patent: Apr. 19, 2016

(54) BOARD TO BOARD ELECTRICAL CONNECTOR ASSEMBLY

(71) Applicant: Advanced-Connectek Inc., New Taipei (TW)

(72) Inventors: Kuo-Ching Lee, New Taipei (TW); Ta-Teh Meng, New Taipei (TW); Shuang-Lin Yuan, Tian-Jin (CN); Mei Shi, Tian-Jin (CN); Chiah-Siang Chang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 14 days.

(21) Appl. No.: 14/509,122

(22) Filed: Oct. 8, 2014

(65) Prior Publication Data

US 2015/0214643 A1 Jul. 30, 2015

(30) Foreign Application Priority Data

Jan. 24, 2014 (CN) ..... 2014 1 0032611

(51) Int. Cl.
*H01R 12/00* (2006.01)
*H01R 12/71* (2011.01)
*H01R 12/70* (2011.01)

(52) U.S. Cl.
CPC ..... *H01R 12/716* (2013.01); *H01R 12/7029* (2013.01)

(58) Field of Classification Search
CPC ..... H01R 9/096–23/725
USPC ..... 439/44, 65, 74
See application file for complete search history.

(56) References Cited

U.S. PATENT DOCUMENTS 5,498,167 A * 3/1996 Seto ..... H01R 12/716 439/284
5,876,217 A * 3/1999 Ito ..... H01R 13/20 439/74
5,885,092 A * 3/1999 Ito ..... H01R 12/716 439/74
2007/0020966 A1 * 1/2007 Lee ..... H01R 12/716 439/74

* cited by examiner

*Primary Examiner* — Vanessa Girardi
(74) *Attorney, Agent, or Firm* — Alan D. Kamrath; Kamrath IP Lawfirm, P.A.

(57) ABSTRACT

The invention relates to an electrical connector assembly comprising a first connector and a second connector. The first connector comprises a first insulating body and first terminals. The first insulating body comprises an inserting wall. The first terminal comprises a U-shaped segment fixed to the inserting wall and a first soldering foot. Two outer surfaces of the U-shaped segment respectively comprise a coupling part. The second connector comprises a second insulating body and second terminals. The second insulating body comprises a receiving trough, separating plates, and separating troughs. The receiving trough matches the inserting wall. The separating plate comprises a first chamfer and a second chamfer. The second terminal comprises a pair of elastic arms, a main arm, and a second soldering foot. The pair of elastic arms is fixed in the receiving trough and matches the U-shaped segment. The main arm is disposed in the separating trough.

9 Claims, 8 Drawing Sheets

BOARD TO BOARD ELECTRICAL CONNECTOR ASSEMBLY

BACKGROUND OF THE INVENTION

1. Field of the Invention

The present invention relates to an electrical connector assembly and, more particularly, to an electrical connector assembly which is board to board (BTB) type.

2. Description of the Prior Art

Electrical devices, especially portable products, tend to become smaller, thinner and lighter. An electrical device usually comprises different circuit boards therein which need to be electrically connected to each other. In order to improve the utilization rate of space inside the electrical device, the different circuit boards are usually applied with a board to board (BTB) electrical connector for electrical connection. The BTB electrical connector is an electrical connector assembly. In general, the electrical connector assembly comprises a plug connector and a receptacle connector corresponding to the plug connector. The plug connector is lined with a plurality of male terminals thereon. The receptacle connector is lined with a plurality of female terminals thereon. When the plug connector is plugged in the receptacle connector, the male terminal matches the female terminal to be electrically connected to each other.

The male terminal mainly comprises a U-shaped segment, and the female terminal mainly comprises a pair of elastic arms. When the male terminal matches the female terminal, the U-shaped segment of the male terminal is clamped by the pair of elastic arms of the female terminal. In the prior art, the match of the male terminal and the female terminal depends on clamping force which is provided by the elastic arms, is against two outer surfaces of the U-shaped segment, and causes friction between the elastic arms and the two outer surfaces. However, strength of the connection of the structure set forth is insufficient. As a result, the elastic arms are easily loosed due to vibration. Furthermore, there exists neither definite sound effect nor coupling point for positioning when the plug connector is plugged in the receptacle connector. As a result, assembling technicians are hard to distinguish whether the male terminals are properly connected to the female terminals or not. Experience of assembling is not well, and the assembly is easily improper to cause failure of electrical connection. In addition, two ends of the plug connector and two ends of the receptacle connector further comprise fixing components. The fixing components are utilized for being soldered to the circuit boards to enhance strength of the connection between the connector and the circuit board. The fixing component of the receptacle connector is usually disposed thereon in an assembly manner, which easily causes crack of the connector, loose of the fixing component, and lack of smoothness of the whole.

SUMMARY OF THE INVENTION

According to the disadvantage of the prior art, the present invention aims to provide an electrical connector assembly, so as to improve experience of assembling, and prevent problems of crack, loose, and lack of smoothness of a connector when fixing components are assembled thereto.

According to the claimed invention, the electrical connector assembly comprises a first connector and a second connector detachably matches the first connector. The first connector comprises a first insulating body and a plurality of first terminals. The first insulating body comprises an inserting wall. The first terminals are lined along the first insulating body. The first terminal comprises a U-shaped segment and a first soldering foot. The U-shaped segment is fixed to the inserting wall. Two outer surfaces of the U-shaped segment opposite each other and facing outward respectively comprise a coupling part. The first soldering foot extends away from the inserting wall.

The second connector comprises a second insulating body and a plurality of second terminals. The second insulating body comprises a receiving trough and a plurality of separating plates. The receiving trough matches the inserting wall and is formed on a front surface of the second insulating body. The separating plates are disposed on a back surface of the second insulating body, and every two adjacent separating plates form a separating trough. The separating plate comprises a first chamfer adjacent to the separating trough and a second chamfer adjacent to a side of the second insulating body. The second terminals are lined along the second insulating body. The second terminal comprises a pair of elastic arms, a main arm, and a second soldering foot. The pair of elastic arms is lined along the main arm and extends in a width direction of the main arm. The pair of elastic arms is fixed in the receiving trough and matches the U-shaped segment. The main arm is disposed in the separating trough. The second soldering foot is connected to the main arm and extends away from the receiving trough in a length direction of the main arm. The second soldering foot is close to the second chamfer. Wherein the inserting wall inserts into the receiving trough, the pair of elastic arms clamps the U-shaped segment, and two free ends of the pair of elastic arms are respectively coupled to the two coupling parts of the U-shaped segment.

According to an embodiment of the claimed invention, one of the two coupling parts is a concave trough and the other one of the two coupling parts is a concave step. The concave trough is formed on a middle of one of the two outer surfaces, and the concave step is formed by concaving the whole of the other one of the two outer surfaces.

According to another embodiment of the claimed invention, the two free ends of the pair of elastic arms respectively comprise a convex structure. The two convex structures extend toward each other. One of the two convex structures is coupled to the concave trough, and the other one of the two convex structures is against the concave step.

According to another embodiment of the claimed invention, two sides of the first soldering foot respectively comprise a fillet. A width of the U-shaped segment is greater than that of the pair of elastic arms.

According to another embodiment of the claimed invention, the second terminal further comprises a fixing arm. The fixing arm and the pair of elastic arms are lined along the main arm and extend in a width direction of the main arm. The fixing arm is fixed in the second insulating body.

According to another embodiment of the claimed invention, the fixing arm comprises a coupling bump. The second insulating body comprises a plurality of fixing troughs. The fixing arm inserts into and is fixed to the fixing trough.

According to another embodiment of the claimed invention, the second soldering foot and the main arm form a height difference in between. The main arm is adjacent to the second insulating body. A side of the second insulating body corresponding to the second soldering foot comprises a step segment. The second soldering foot is spaced out the step segment from an interval.

According to another embodiment of the claimed invention, the second insulating body further comprises two projections and two guide slots. The two projections are respectively disposed on two ends of the front surface of the second insulating body. The two guide slots are disposed on the front surface of the second insulating body and are respectively positioned on two ends of the receiving trough. The two guide slots match two ends of the first insulating body.

According to another embodiment of the claimed invention, the second connector further comprises second fixing components. The second fixing components are disposed on two ends of the second insulating body. The second fixing components are fixed to the second insulating body in an insert molding manner. The second fixing component comprises a second soldering part. The second soldering part extends outside the second insulating body.

The electrical connector assembly of the present invention enhances strength of the connection and decreases possibility of loosing connection when the first terminal matches the second terminal. The present invention also improves experience of assembling the first connector to the second connector, and adds a positioning effect when the first terminal matches the second terminal. In addition, the second fixing components are fixed to the second insulating body in an insert molding manner, so as to prevent problems of crack, loose, and lack of smoothness of the second connector when second fixing components are assembled to a second insulating body in the prior art.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
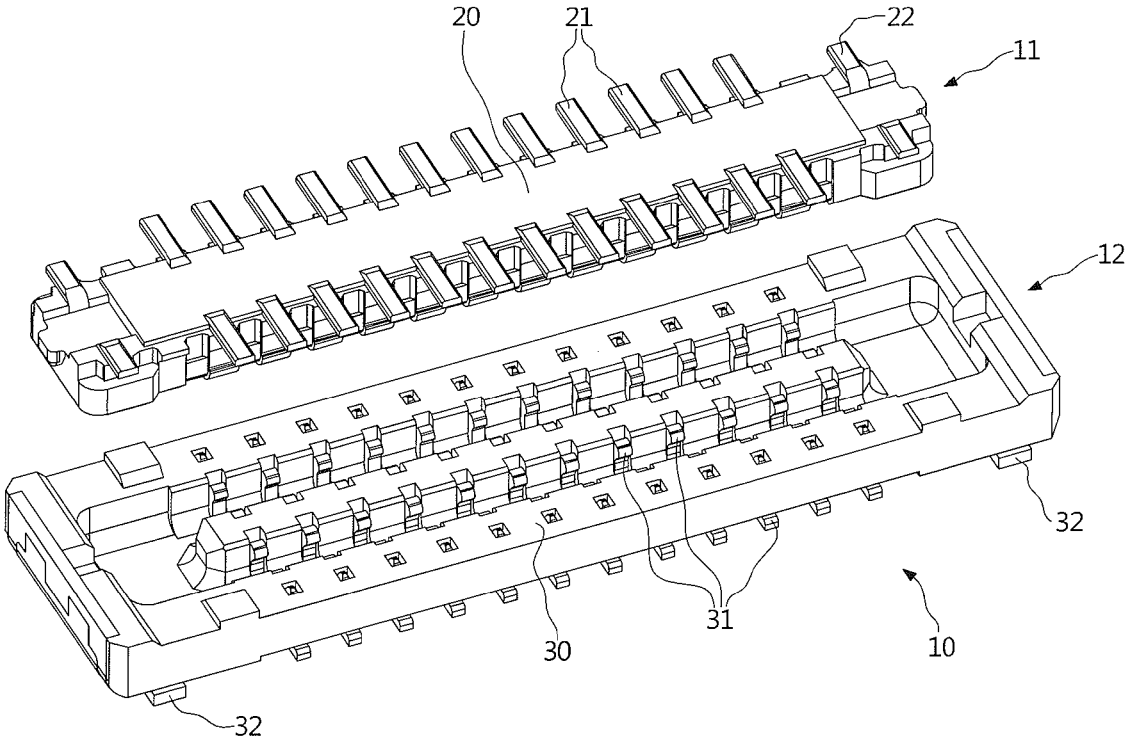
FIG. 1 is a diagram of an electrical connector assembly according to a preferred embodiment of the present invention.
Figure 2:
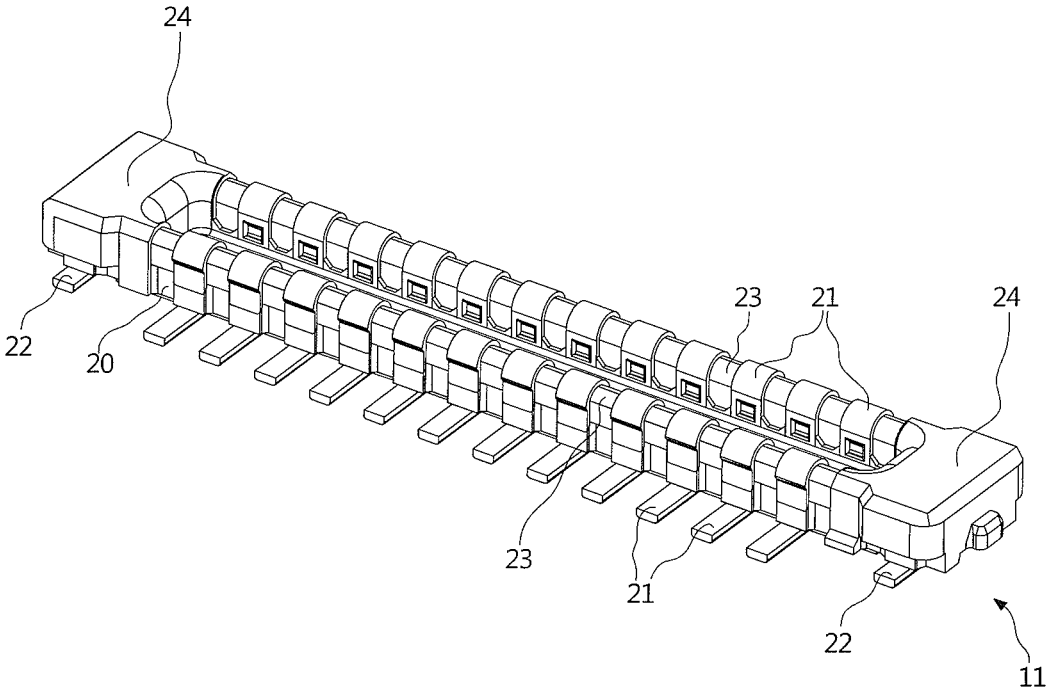
FIG. 2 is a diagram of a first connector according to the preferred embodiment taken from another viewing angle.
Figure 3:
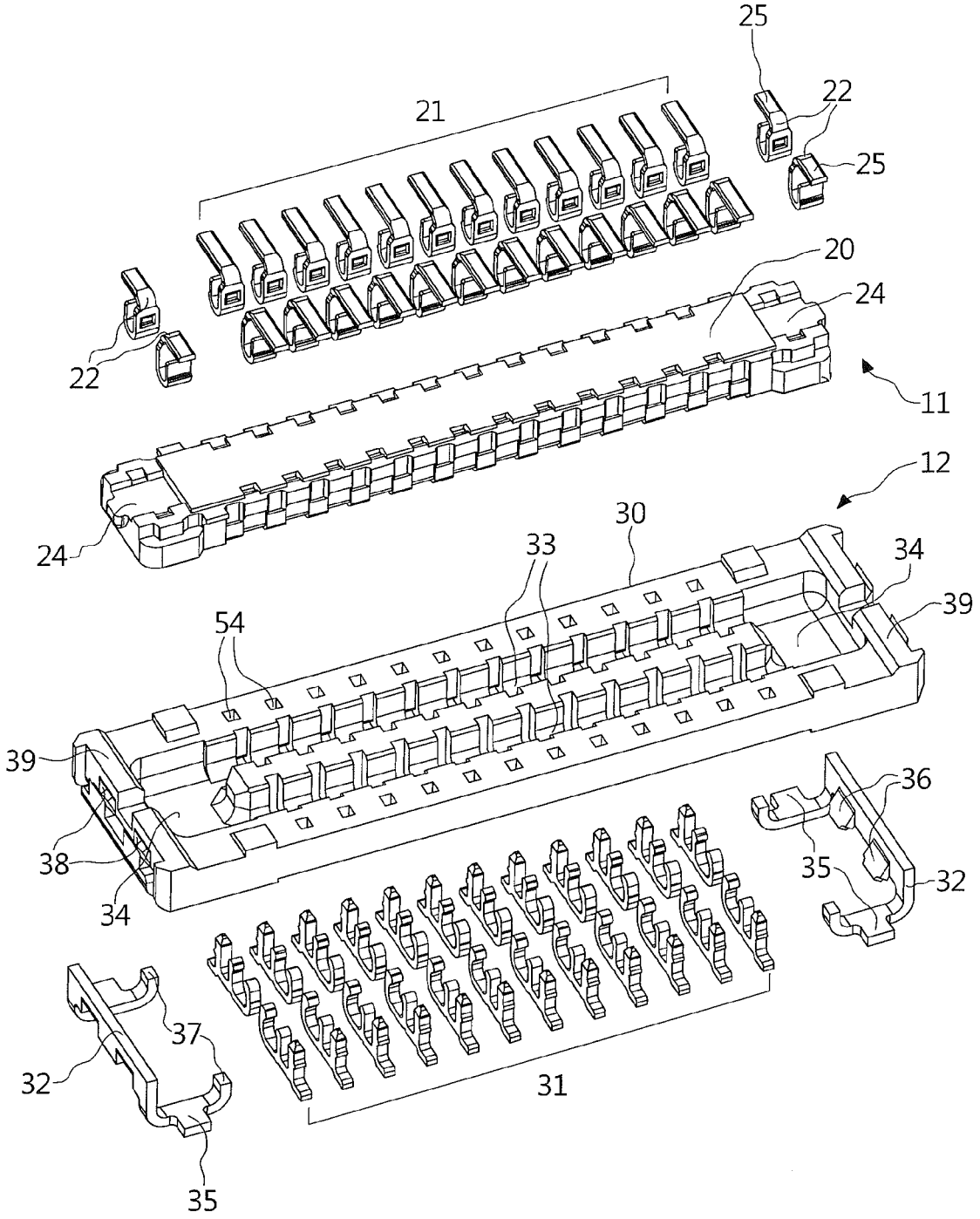
FIG. 3 is an exploded view of the electrical connector assembly according to the preferred embodiment.

Refer to FIG. 1, FIG. 2, and FIG. 3. FIG. 1 illustrates an electrical connector assembly. FIG. 2 illustrates a first connector taken from another viewing angle. FIG. 3 illustrates an exploded view of the electrical connector assembly. An electrical connector assembly 10 comprises a first connector 11 and a second connector 12 detachably matching the first connector 11. In the embodiment, the electrical connector assembly 10 is a board to board (BTB) electrical connector. The first connector 11 is a plug connector, and the second connector 12 is a receptacle connector.

The first connector 11 comprises a first insulating body 20, a plurality of first terminals 21, and first fixing components (also known as hold down components) 22. The first insulating body 20 comprises two inserting walls 23, as shown in FIG. 2. The two inserting walls 23 are opposite and parallel to each other. The first terminals 21 are lined along the first insulating body 20 and are aligned in two opposite rows. A part of the first terminal 21 is disposed on the inserting wall 23. Two ends of the first insulating body 20 respectively comprise a head portion 24. A width of the head portion 24 is increased in a width direction thereof relative to a middle portion of the first insulating body 20, i.e. the part with inserting walls 23; therefore, the width of the head portion 24 is slightly greater than that of the middle portion of the first insulating body 20. The first fixing component 22 comprises a first soldering part 25, as shown in FIG. 3. The first fixing component 22 is fixed to the head portion 24, and the first soldering part 25 extends outside the head portion 24. The first soldering part 25 of the first fixing component 22 can be soldered to a circuit board (not shown) to enhance strength of the connection between the first connector 11 and the circuit board. In the embodiment, the first terminal 21, the first fixing component 22, and the first insulating body 20 are connected to each other in an insert molding manner. The first insulating body 20 compactly packs the first terminals 21 and the first fixing components 22 by the manner; therefore, solder paste and flux can be barricaded to stay outside of the first insulating body 20 when processing a surface mount technology (SMT) process.

The second connector 12 comprises a second insulating body 30, a plurality of second terminals 31, and second fixing components 32. The second insulating body 30 comprises two receiving troughs 33. The two receiving troughs 33 are opposite and parallel to each other. The receiving troughs 33 are formed on a front surface of the second insulating body 30. The receiving troughs 33 are utilized for matching the inserting walls 23. The second terminals 31 are lined along the second insulating body 30 and aligned in two opposite rows. A part of the second terminal 31 is disposed in the receiving trough 33. The second insulating body 30 further comprises two projections 39 and two guide slots 34. The two projections 39 are respectively disposed on two ends of the front surface of the second insulating body 30; therefore, the projection 39 and the front surface of the second insulating body 30 form a height difference. The two guide slots 34 are disposed on the front surface of the second insulating body 30 and are respectively positioned on two ends of the receiving trough 33. The guide slot 34 is connected to the receiving trough 33. The guide slot 34 comprises a U-shaped guiding structure which matches the head portion 24 of the first insulating body 20. During blind matching, the guide slot 34 provides a well guiding effect for guiding the first connector 11 to successfully match the second connector 12. The inserting wall 23 can be guided by the guide slot 34 to align with and insert into the receiving trough 33. The projection 39 can prevent relative high friction generated by relative large surface area contact between the first connector 11 and the second connector 12 during matching process. Instead, since only the projection 39 contacts the first connector 11 during matching process, relative low friction is generated between the first connector 11 and the second connector 12; therefore, matching process can be smoother. The projection 39 and the guide slot 34 provide a well guiding effect, such that the first insulating body 20 and the second insulating body 30 are hardly damaged during matching process, and the terminals can be protected by the structure set forth.

The second fixing component 32 comprises second soldering parts 35, inclined plates 36, and hooks 37. The second fixing components 32 are fixed to two ends of the second insulating body 30. The inclined plate 36 is embedded in an inclined trough 38, as shown in FIG. 3, and the hook 37 is inserted into a bottom part of the second insulating body 30, and thereby strength of the connection between the second fixing component 32 and the second insulating body 30 can be enhanced. The second soldering part 35 extends outside the second insulating body 30. The second soldering part 35 of the second fixing component 32 can be soldered to a circuit board to enhance strength of the connection between the second connector 12 and the circuit board. In the embodiment, the second terminals 31 are connected to the second insulating body 30 in an assembly manner to retain elasticity of the second terminals 31. The second fixing components 32 are fixed to the second insulating body 30 in an insert molding manner to prevent problems of crack, loose, and lack of smoothness when the second fixing components 32 are assembled to the second insulating body 30.

Figure 4:
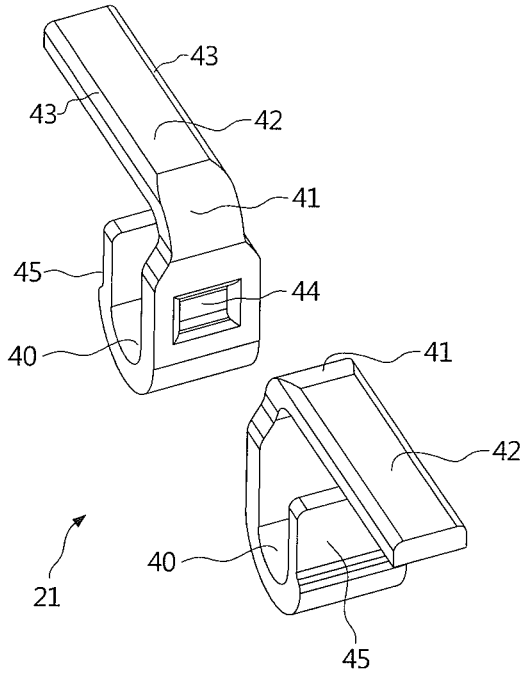
FIG. 4 is a diagram of a first terminal according to the preferred embodiment.

Refer to FIG. 4. FIG. 4 illustrates one pair of first terminals 21. The first terminal 21 comprises a U-shaped segment 40, an L-shaped segment 41, and a first soldering foot 42. The U-shaped segment 40 is fixed to the inserting wall 23, as shown in FIG. 2. One end of the L-shaped segment 41 is connected to the first soldering foot 42 and the other end of the L-shaped segment 41 is connected to the U-shaped segment 40. The first soldering foot 42 extends away from the inserting wall 23. Widths of the first soldering foot 42 and the L-shaped segment 41 are decreased in a width direction relative to the U-shaped segment 40. The first soldering foot 42 can be soldered to a circuit board. Two sides of the first soldering foot 42 respectively comprise a fillet 43 which can increase surface area for contacting solder paste to enhance strength of connection. Two outer surfaces of the U-shaped segment 40 opposite each other and facing outward respectively comprise a coupling part. The two coupling parts comprise a concave trough 44 and a concave step 45. The concave trough 44 is formed on a middle of one of the two outer surfaces of the U-shaped segment 40, and the concave step 45 is formed by concaving the whole of the other one of the two outer surfaces of the U-shaped segment 40. A nickel barrier area for efficiently barricading solder paste during a SMT process is further formed on the first soldering foot 42 by using a laser lift-off technology manner.

Figure 5:
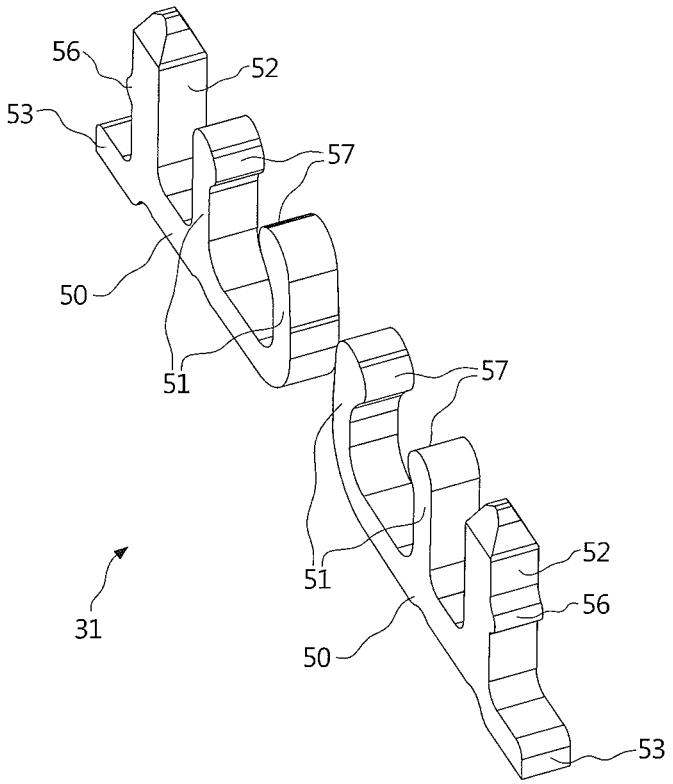
FIG. 5 is a diagram of a second terminal according to the preferred embodiment.
Figure 6:
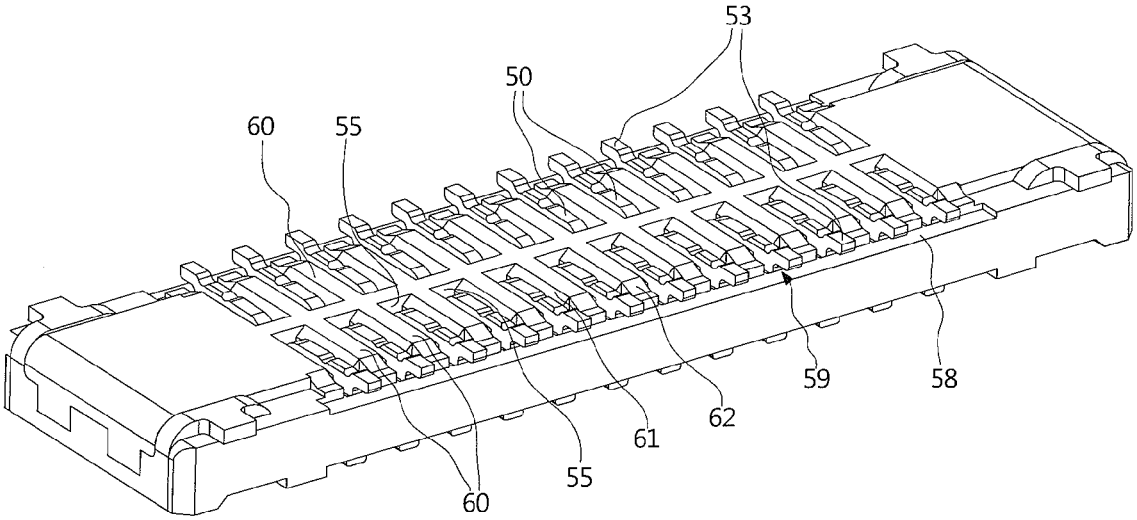
FIG. 6 is a diagram of a second connector according to the preferred embodiment taken from another viewing angle.

Refer to FIG. 5 and FIG. 6. FIG. 5 illustrates one pair of second terminals 31. FIG. 6 illustrates the second connector 12 taken from another viewing angle. The second terminal 31 comprises a main arm 50, a pair of elastic arms 51, a fixing arm 52, and a second soldering foot 53. The fixing arm 52 and the pair of elastic arms 51 are respectively lined along the main arm 50 in order and extend in a width direction of the main arm 50. The second soldering foot 53 is connected to the main arm 50 and extends away from the receiving trough 33 in a length direction of the main arm 50. The second soldering foot 53 is utilized for being soldered to a circuit board. The second insulating body 30 comprises a plurality of fixing troughs 54, as shown in FIG. 3. The fixing trough 54 penetrates the front surface and a back surface of the second insulating body 30. The back surface of the second insulating body 30 further comprises a plurality of separating plates 60, and every two adjacent separating plates 60 form a separating trough 55, as shown in FIG. 6. During assembling the second terminal 31 to the second insulating body 30, the fixing arm 52 is aligned with and then inserts into the fixing trough 54. The fixing arm 52 further comprises a coupling bump 56 which can enhance strength of the connection of the fixing arm 52 and the fixing trough 54. After assembly completed, the main arm 50 is disposed in the separating trough 55, and the pair of elastic arms 51 is fixed in the receiving trough 33.

Two free ends of the pair of elastic arms 51 respectively comprise a convex structure 57, and the two convex structures 57 extend toward each other. The pair of elastic arms 51 is utilized for matching the U-shaped segment 40. When the pair of elastic arms 51 matches the U-shaped segment 40, the two convex structures 57 contact two points of the U-shaped segment 40, and the pair of elastic arms 51 elastically clamps the U-shaped segment 40; therefore, the connection of the U-shaped segment 40 and the pair of elastic arms 51 is hardly loose due to vibration. In addition, a width of the U-shaped segment 40 is greater than that of the pair of elastic arms 51, such that the match of the first terminal 21 and the second terminal 31 has high fault tolerance which tolerates misplacement between the U-shaped segment 40 and the corresponding pair of elastic arms 51 to a certain extent, so as to prevent problems of loosing connection and causing open circuit when situations like misplacement, vibration or impact occur. The second terminal 31 is preferably a blanking type terminal of which wipe length is longer than that of a forming type terminal. The longer wipe length is of benefit to scrape dirt and oxide layer on the surface of the terminal.

The second soldering foot 53 and the main arm 50 form a height difference in between. In other words, the main arm 50 forms a lifting structure relative to the second soldering foot 53. In addition, as shown in FIG. 6, two sides of the second insulating body 30, which are close to the second soldering feet 53, respectively comprise a concave step segment 58. The separating plate 60 comprises a first chamfer 61 and a second chamfer 62. The first chamfer 61 is adjacent to the separating trough 55, and the second chamfer 62 is adjacent to the sides of the second insulating body 30. The second soldering foot 53 is close to the second chamfer 62. After the second terminal 31 is assembled to the second insulating body 30, the main arm 50 in the separating trough 55 is adjacent to the second insulating body 30, and the second soldering foot 53 is spaced out the second insulating body 30 from an interval 59 because of the lifting structure which the main arm 50 forms relative to the second soldering foot 53, as shown in FIG. 5, and the step segment 58. The interval 59 serves as an air trough. During a SMT process, the air trough can prevent solder wicking. Also, the convex structure 57 and the second soldering foot 53 can be applied with a spot plating manner to decrease defective rate of the SMT process. The second connector 12 which is assembled to a circuit board forms gaps between the first chamfer 61, the second chamfer 62, and the circuit board. Air flows in the gaps can be of benefit to dissipate heat generated by the second terminals 31 when the second connector 12 operates.

Figure 7:
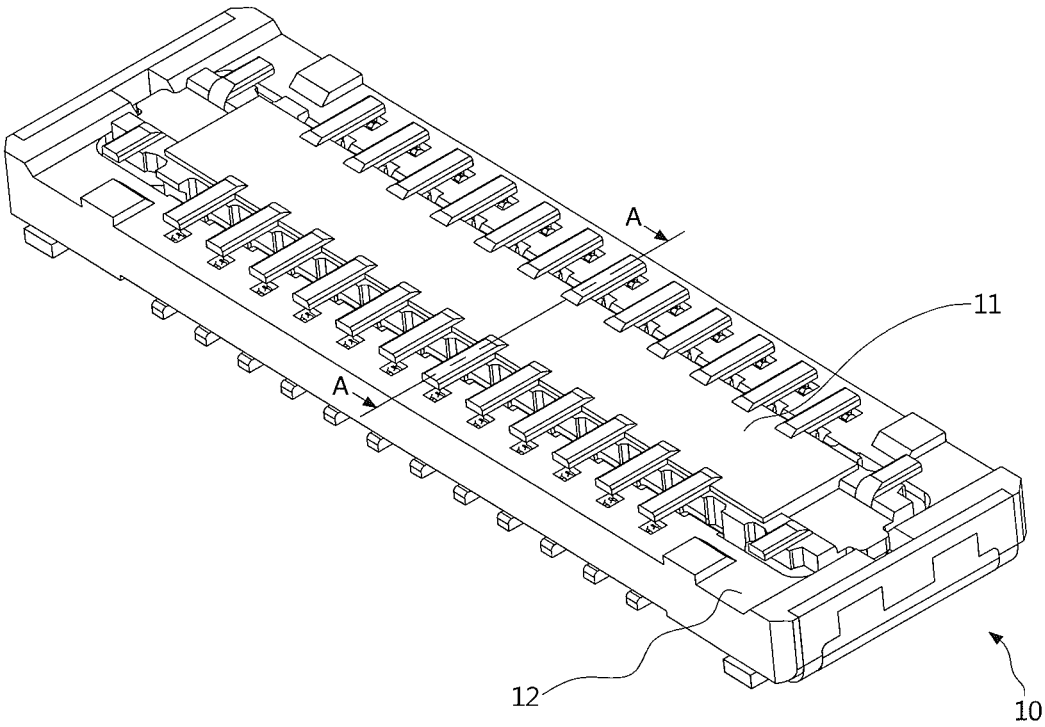
FIG. 7 is a diagram of the first connector matched the second connector according to the preferred embodiment.
Figure 8:
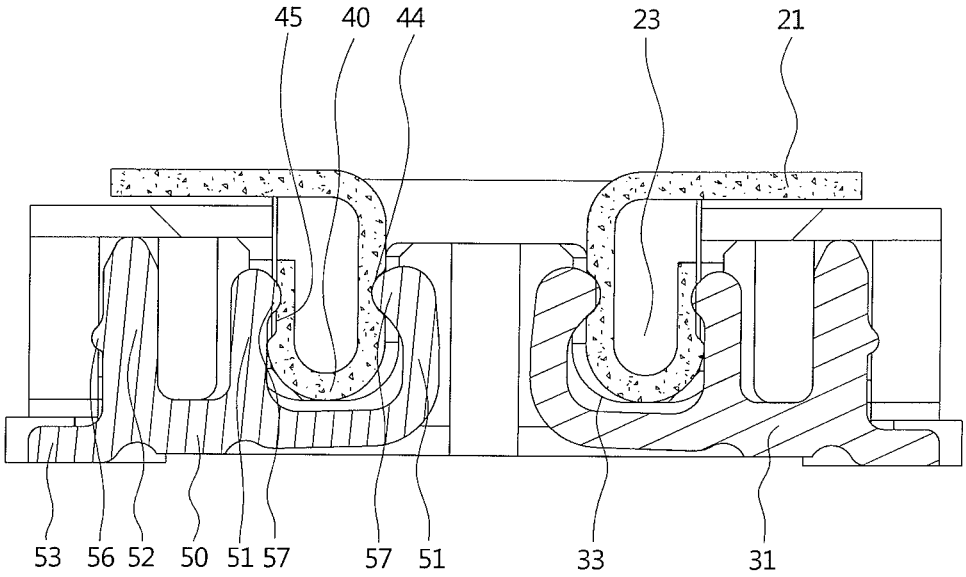
FIG. 8 is a cross-sectional view of the first connector matched the second connector according to the preferred embodiment.

Refer to FIG. 7 and FIG. 8. FIG. 7 illustrates the first connector 11 matched the second connector 12. FIG. 8 illustrates a cross-sectional view of the first connector 11 matched the second connector 12. The cross-sectional view of FIG. 8 is according to the A-A line of FIG. 7. The first connector 11 can be detachably connected to the second connector 12. When the first connector 11 matches the second connector 12, the inserting wall 23 inserts into the receiving trough 33, the pair of elastic arms 51 clamps the U-shaped segment 40, and the two free ends of the pair of elastic arms 51 are respectively coupled to the two coupling parts. More specifically, one of the two convex structures 57 of the pair of elastic arms 51 is coupled to the concave trough 44, and the other one of the two convex structures 57 is against the concave step 45. During a process of inserting the U-shaped segment 40 into the pair of elastic arms 51, when once the two convex structures 57 fall into the concave trough 44 and the concave step 45, a sound and a vibration for positioning occur, which can help a technician to confirm whether the first connector 11 and the second connector 12 is properly assembled. In addition, the U-shaped segment 40 per se is a guiding structure with a big round, which is of benefit to be plugged in or be pulled out and provides a well guiding effect for inserting into the pair of elastic arms 51. The outer surface of the U-shaped segment 40 is a smooth surface of a burnished metal, which can also serve as a guiding interface.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical connector assembly comprising: a first connector comprising:

a first insulating body comprising an inserting wall; and a plurality of first terminals lined along the first insulating body, wherein the first terminal comprises a U-shaped segment and a first soldering foot, the U-shaped segment is fixed to the inserting wall, two outer surfaces of the U-shaped segment opposite each other and facing outward respectively comprise a coupling part, and the first soldering foot extends away from the inserting wall; and a second connector detachably matching the first connector and comprising:

a second insulating body comprising a receiving trough and a plurality of separating plates, wherein the receiving trough matches the inserting wall and is formed on a front surface of the second insulating body, the separating plates are disposed on a back surface of the second insulating body, and every two adjacent separating plates form a separating trough, wherein each separating plate comprises a first chamfer adjacent to the separating trough and a second chamfer adjacent to a side of the second insulating body; and a plurality of second terminals lined along the second insulating body, wherein the second terminal comprises a pair of elastic arms, a main arm, and a second soldering foot, wherein the pair of elastic arms is lined along the main arm, extends in a width direction of the main arm, is fixed in the receiving trough, and matches the U-shaped segment, wherein the main arm is disposed in the separating trough, and the second soldering foot is connected to the main arm, extends away from the receiving trough in a length direction of the main arm, and is close to the second chamfer;

wherein the inserting wall inserts into the receiving trough, the pair of elastic arms clamps the U-shaped segment, and two free ends of the pair of elastic arms are respectively coupled to the two coupling parts of the U-shaped segment.

2. The electrical connector assembly of claim 1, wherein two sides of the first soldering foot respectively comprise a fillet, and a width of the U-shaped segment is greater than that of the pair of elastic arms.

3. The electrical connector assembly of claim 1, wherein the second insulating body further comprises two projections and two guide slots, the two projections are respectively disposed on two ends of the front surface of the second insulating body, the two guide slots are disposed on the front surface of the second insulating body and are respectively positioned on two ends of the receiving trough, and the two guide slots match two ends of the first insulating body.

4. The electrical connector assembly of claim 1, wherein the second connector further comprises second fixing components, the second fixing components are disposed on two ends of the second insulating body, and the second fixing components are fixed to the second insulating body in an insert molding manner, wherein the second fixing component comprises a second soldering part, and the second soldering part extends outside the second insulating body.

5. The electrical connector assembly of claim 1, wherein one of the two coupling parts is a concave trough and the other one of the two coupling parts is a concave step, the concave trough is formed on a middle of one of the two outer surfaces, and the concave step is formed by concaving the whole of the other one of the two outer surfaces.

6. The electrical connector assembly of claim 5, wherein the two free ends of the pair of elastic arms respectively comprise a convex structure, the two convex structures extend toward each other, one of the two convex structures is coupled to the concave trough, and the other one of the two convex structures is against the concave step.

7. The electrical connector assembly of claim 1, wherein the second terminal further comprises a fixing arm, the fixing arm and the pair of elastic arms are lined along the main arm and extend in a width direction of the main arm, and the fixing arm is fixed in the second insulating body.

8. The electrical connector assembly of claim 7, wherein the fixing arm comprises a coupling bump, the second insulating body comprises a plurality of fixing troughs, and the fixing arm inserts into and is fixed to the fixing trough.

9. The electrical connector assembly of claim 7, wherein the second soldering foot and the main arm form a height difference in between, the main arm is adjacent to the second insulating body, a side of the second insulating body corresponding to the second soldering foot comprises a step segment, and the second soldering foot is spaced out the step segment from an interval.

* * * * *